US011713870B1

(12) United States Patent
Boyd

(10) Patent No.: US 11,713,870 B1
(45) Date of Patent: Aug. 1, 2023

(54) ILLUMINATED LANDSCAPING ASSEMBLY AND METHOD OF USE

(71) Applicant: Bennie Boyd, Indianapolis, IN (US)

(72) Inventor: Bennie Boyd, Indianapolis, IN (US)

( * ) Notice: Subject to any disclaimer, the term of this patent is extended or adjusted under 35 U.S.C. 154(b) by 0 days.

(21) Appl. No.: 17/961,370

(22) Filed: Oct. 6, 2022

(51) Int. Cl.
*F21V 23/06* (2006.01)
*F21Y 115/10* (2016.01)

(52) U.S. Cl.
CPC ..... *F21V 23/06* (2013.01); *F21Y 2115/10* (2016.08)

(58) Field of Classification Search
CPC ..... F21S 8/081; F21V 23/06
See application file for complete search history.

(56) References Cited

U.S. PATENT DOCUMENTS

| | | | | |
|---|---|---|---|---|
| 5,410,458 | A | 4/1995 | Bell | |
| 8,312,679 | B1 | 11/2012 | Roscke s | |
| 8,371,894 | B1 * | 2/2013 | Rosen | A63H 33/086 446/485 |
| 9,732,952 | B2 | 8/2017 | Freill | |
| D839,635 | S | 2/2019 | Girard | |
| 10,697,596 | B2 | 6/2020 | Mullen | |
| 11,000,142 | B2 | 5/2021 | Girard | |
| 2008/0151545 | A1 * | 6/2008 | Kratz | F21V 21/116 362/249.01 |
| 2010/0235009 | A1 * | 9/2010 | Banks | H02M 7/003 700/295 |
| 2010/0302765 | A1 * | 12/2010 | Yu | F21S 9/037 362/183 |
| 2011/0019416 | A1 * | 1/2011 | Poissonnet | F21V 25/12 362/249.02 |
| 2015/0168628 | A1 | 6/2015 | Niu | |
| 2016/0123569 | A1 * | 5/2016 | Cummings | F21K 9/20 362/249.02 |
| 2017/0127618 | A1 | 5/2017 | Bell | |

FOREIGN PATENT DOCUMENTS

| | | |
|---|---|---|
| CA | 2925151 | 11/2016 |

* cited by examiner

*Primary Examiner* — Christopher E Dunay

(57) ABSTRACT

An illuminated landscaping assembly for illuminating landscaping includes a plurality of lighting modules, each comprising a housing that defines an interior space. A first connector and a second connector are attached to a first edge and a second edge of the housing, respectively. The second connector is complementary to the first connector so that the lighting modules are physically and electrically interconnectable via selective connection of the first connectors and the second connectors. A plurality of bulbs is attached to an upper face of the housing and is operationally engaged to the first connector and the second connector. A shell, which is substantially transparent, is attached to the housing and encapsulates the plurality of bulbs. A respective one of the first connectors and the second connectors is engaged a power cord extending from a power module. With the lighting modules positioned in a landscape, the bulbs selectively illuminate the landscape.

12 Claims, 5 Drawing Sheets

ILLUMINATED LANDSCAPING ASSEMBLY AND METHOD OF USE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to lighting assemblies and more particularly pertains to a new lighting assembly for illuminating landscaping. The present invention discloses a lighting assembly for outdoor use in landscaping to enhance curb appeal and safety.

(2) Description of Related Art Including Information Disclosed Under 37 CFR 1.97 and 1.98

The prior art relates to lighting assemblies, which may comprise modular low voltage lighting assemblies, lighted landscape edging, tubing covered light emitting diode strings, and simulated rocks with lights. Related prior art comprises floor mats with integral lighting. What is lacking in the prior art is a lighting assembly comprising a plurality of lighting modules, which are physically and electrically interconnectable via selective connection of first and second connectors. The plurality of lighting modules is configured to be positioned in a landscape, which is illuminated by bulbs of the lighting modules.

(h) BRIEF SUMMARY OF THE INVENTION

An embodiment of the disclosure meets the needs presented above by generally comprising a plurality of lighting modules, each comprising a housing that defines an interior space. A first connector and a second connector are attached to a first edge and a second edge of the housing, respectively. The second connector is complementary to the first connector so that the lighting modules are physically and electrically interconnectable via selective connection of the first connectors and the second connectors. The plurality of lighting modules is configured to be positioned in a landscape. A plurality of bulbs is attached to an upper face of the housing and is operationally engaged to the first connector and the second connector. A shell, which is substantially transparent, is attached to the housing and encapsulates the plurality of bulbs. A respective one of the first connectors and the second connectors is configured to engage a power cord extending from a power module. The bulbs thus are configured to selectively illuminate the landscape.

Another embodiment of the disclosure includes a method comprising a provision step, which entails which entails providing a power module, which has a power cord, and an illuminated landscaping assembly, as disclosed above. The lighting modules are positioned in a desired configuration in a landscape and interconnected. A respective one of the first connectors and the second connectors is connected to the power module using the power cord so that the bulbs are positioned to selectively illuminate the landscape.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
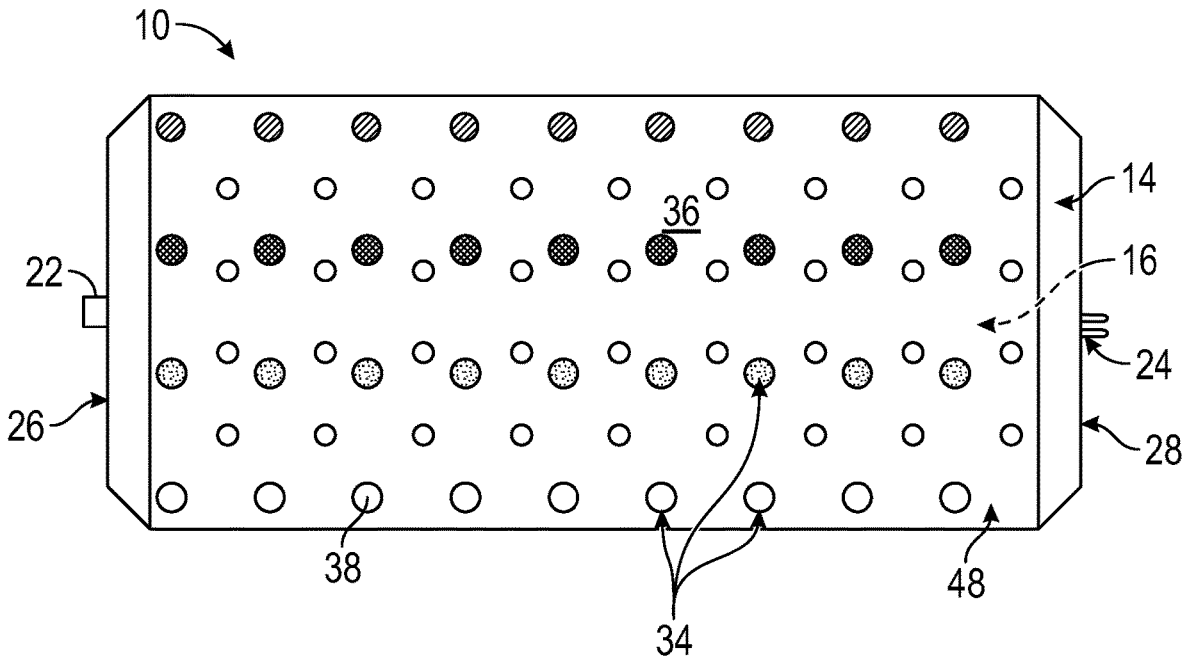
FIG. 1 is a top view of an illuminated landscaping assembly according to an embodiment of the disclosure.

With reference now to the drawings, and in particular to FIGS. 1 through 7 thereof, a new lighting assembly embodying the principles and concepts of an embodiment of the disclosure and generally designated by the reference numeral 10 will be described.

As best illustrated in FIGS. 1 through 7, the illuminated landscaping assembly 10 generally comprises a plurality of lighting modules 12, which is configured to be positioned in a landscape, such as, but not limited to, around decks, trees, landscape monuments, mulch beds, and the like, and also along walkways, driveways, and the like. Each lighting module 12 comprises a housing 14, which defines an interior space 16. A plurality of feet 18 may be attached to a lower face 20 of the housing 14. The feet 18 are configured to elevate the housing 14 above a surface upon which the housing 14 is positioned.

A first connector 22 and a second connector 24 are attached to a first edge 26 and to a second edge 28 of the housing 14, respectively. The second connector 24 is complementary to the first connector 22 so that the lighting modules 12 are physically and electrically interconnectable via selective connection of the first connectors 22 and the second connectors 24. The second connector 24 may comprise a two pronged plug 30 and the first connector 22 may comprise a socket connector 32, as shown in FIG. 1. The present invention also anticipates the second connector 24 and the first connector 22 comprising other connecting means known to those skilled in the art of landscape lighting.

A plurality of bulbs 34 is attached to an upper face 36 of the housing 14 and is operationally engaged to the first connector 22 and the second connector 24. Each bulb 34 comprises a light emitting diode 38. Each bulb 34 emits a respective color so that the plurality of bulbs 34 comprises bulbs 34 emitting a plurality of colors. A plurality of sockets 40 is attached to the upper face 36 of the housing 14. The sockets 40 are complementary to bases 42 of the bulbs 34 so that the bulbs 34 are removably attachable to the housing 14 and thus replaceable when they burn out.

A shell 44, which is substantially transparent, is attached to the housing 14 and encapsulates the plurality of bulbs 34. The present invention anticipates the shell 44 being removably attached to the housing 14 to allow for changing of the bulbs 34. The shell 44 may comprise plastic, glass, or the like, and serves to keep the bulbs 34 dry while allowing for transmission of light.

Figure 3:
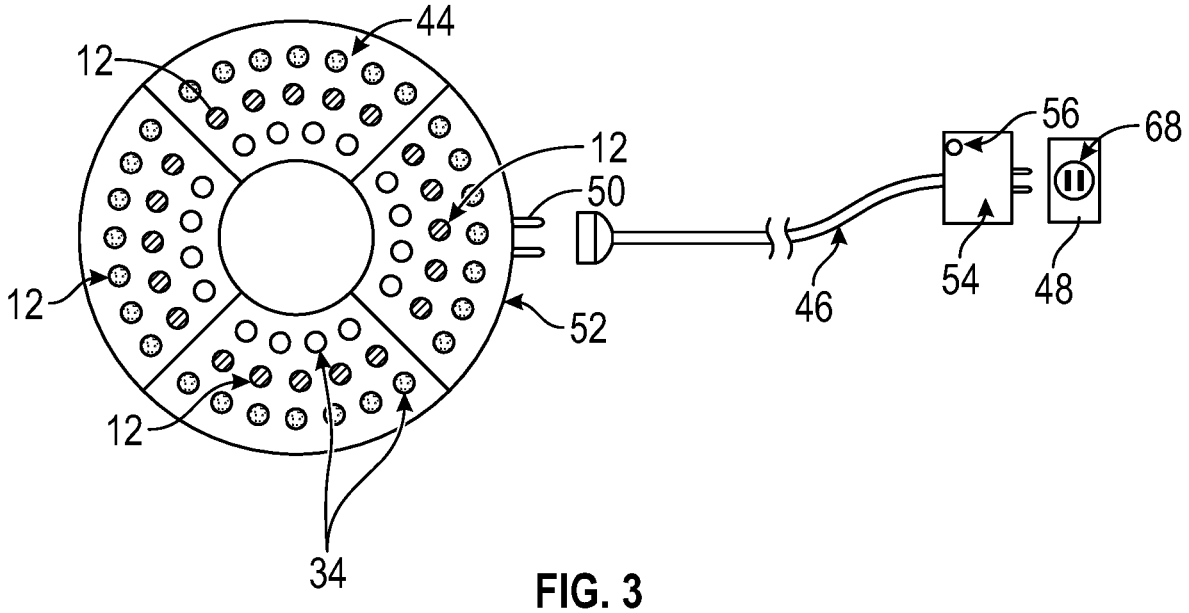
FIG. 3 is a top view of an embodiment of the disclosure.

A respective one of the first connectors 22 and the second connectors 24 is configured to engage a power cord 46 extending from a power module 48, as shown in FIG. 3. The bulbs 34 thus are configured to selectively illuminate the landscape. Illumination of the landscape improves curb appeal for a property upon which the illuminated landscaping assembly 10 is installed and increases safety at night. The present invention anticipates the power module 48 comprising one or more of a battery, which could be recharged using solar panels, and an electrical circuit 68, as shown in FIG. 3.

Figure 2:
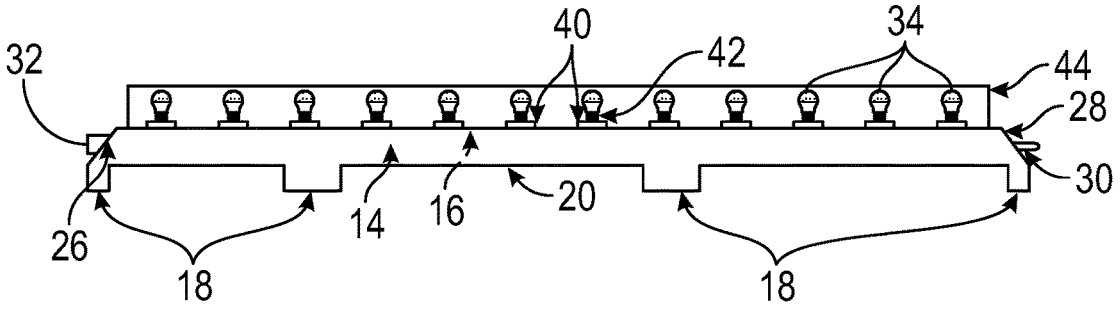
FIG. 2 is a side view of an embodiment of the disclosure.
Figure 5:
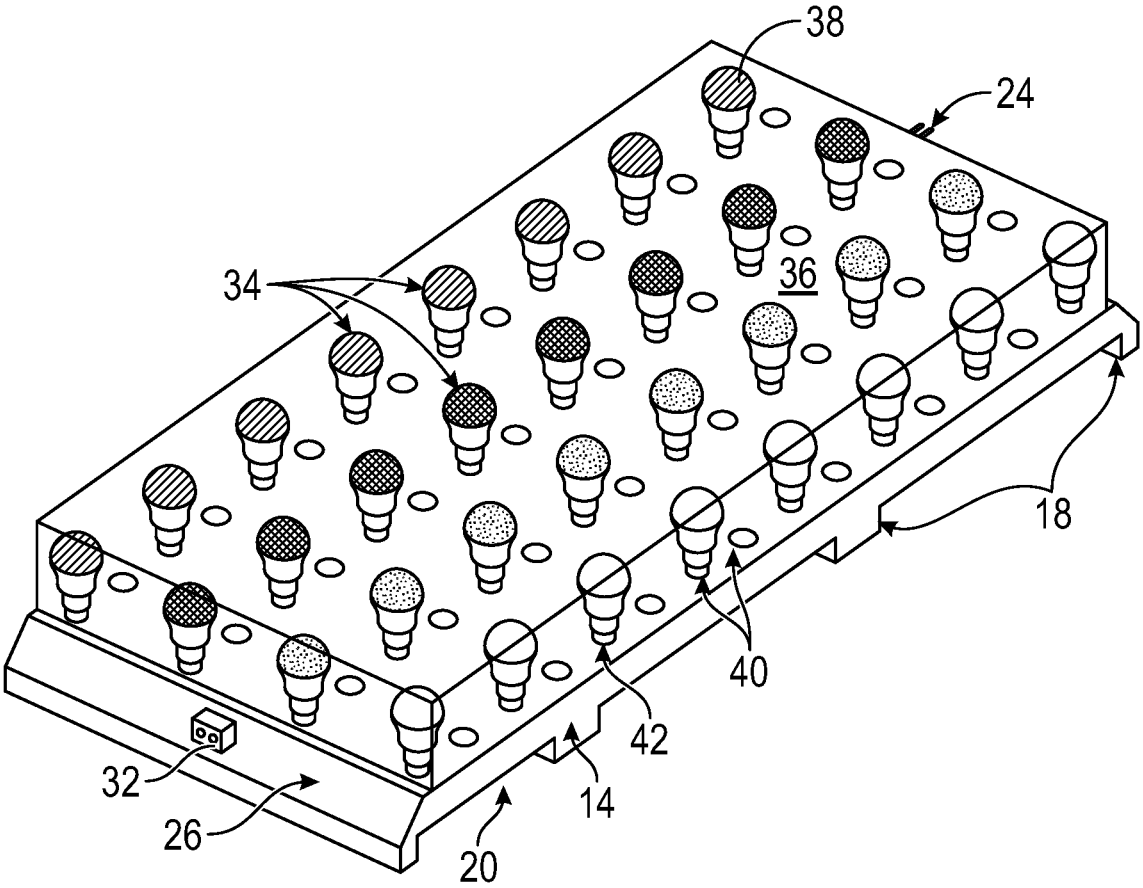
FIG. 5 is an isometric perspective view of an embodiment of the disclosure.
Figure 6:
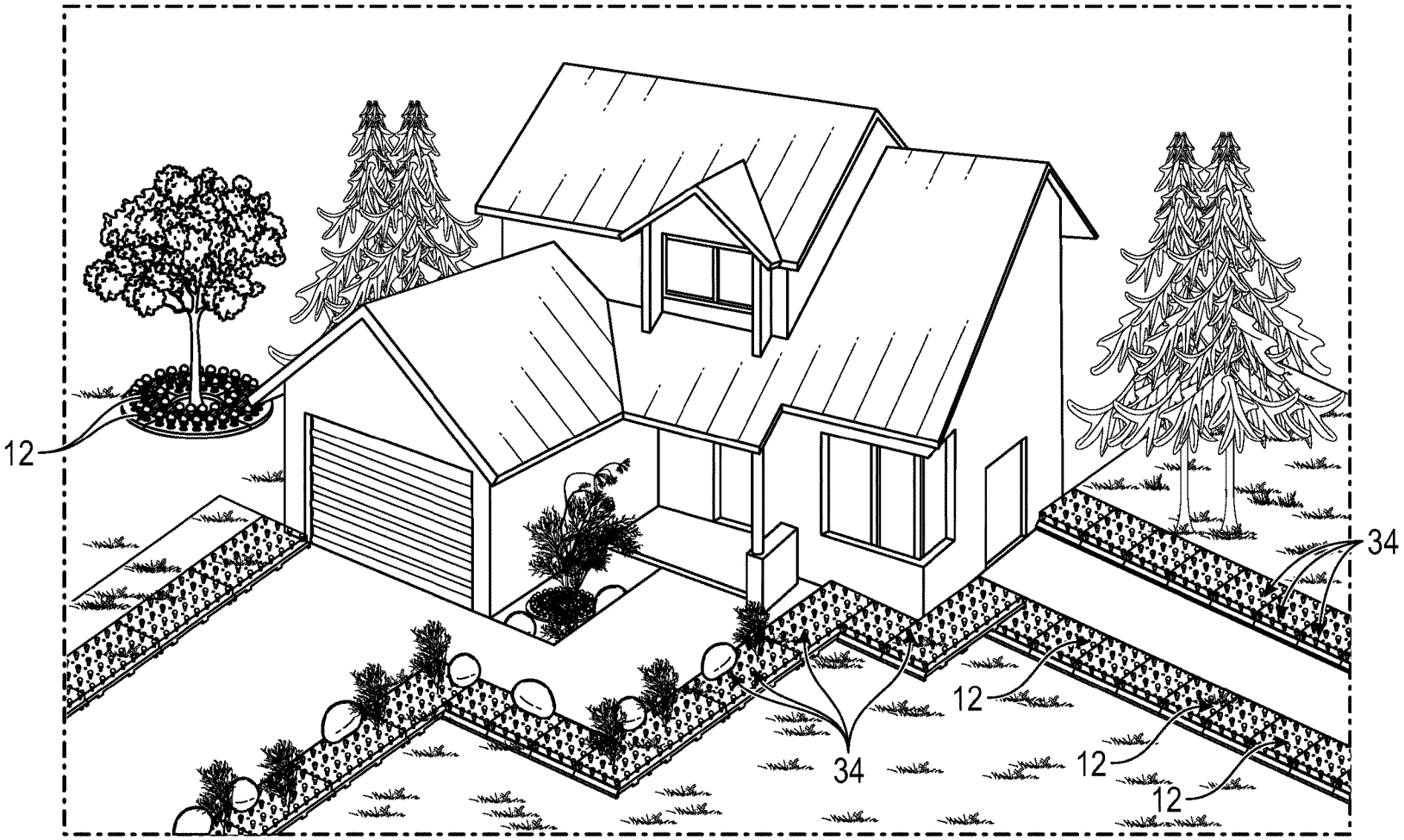
FIG. 6 is an in-use view of an embodiment of the disclosure.
Figure 7:
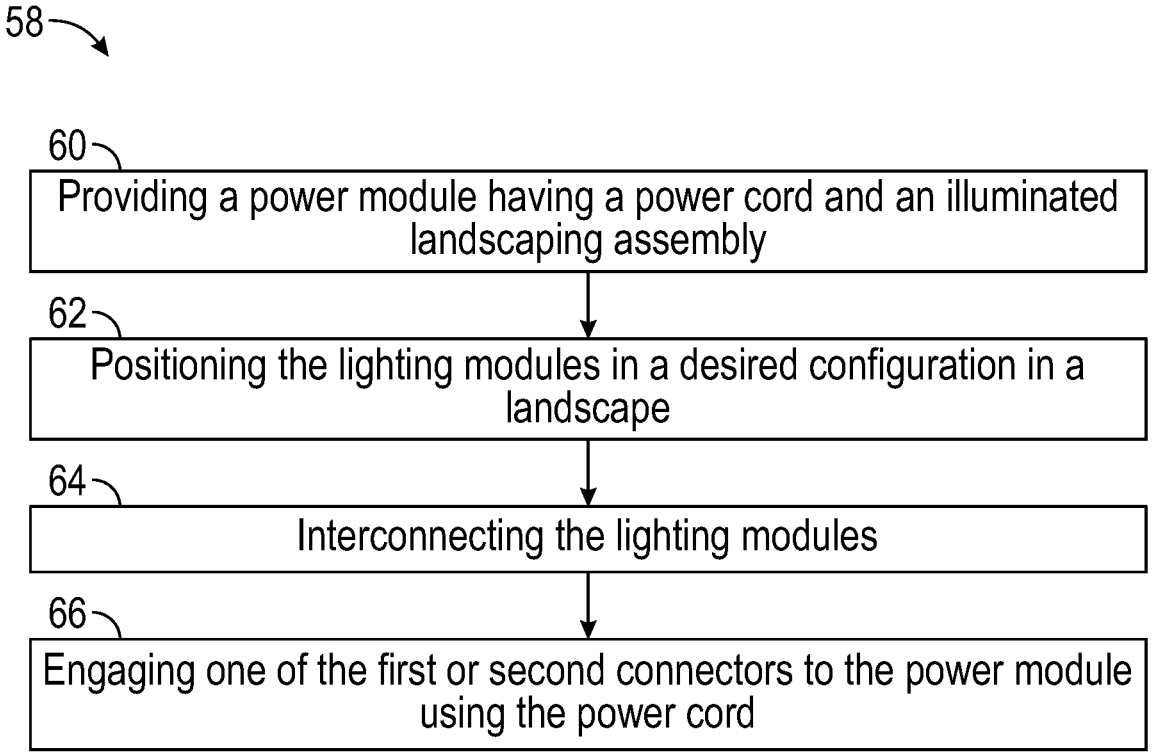
FIG. 7 is a flow diagram for a method utilizing an embodiment of the disclosure.

As shown in FIGS. 1, 2, and 5, the housing 14 is cuboid so that the lighting modules 12 are selectively interconnectable in a linear configuration and a configuration having one or more right angles. As shown in FIG. 1, the first edge 26 and the second edge 28 are opposing, thus allowing for linear connections of the lighting modules 12. The first edge 26 and the second edge 28 also are anticipated to be adjacent, thus allowing for configurations having one or more right angles.

Figure 4:
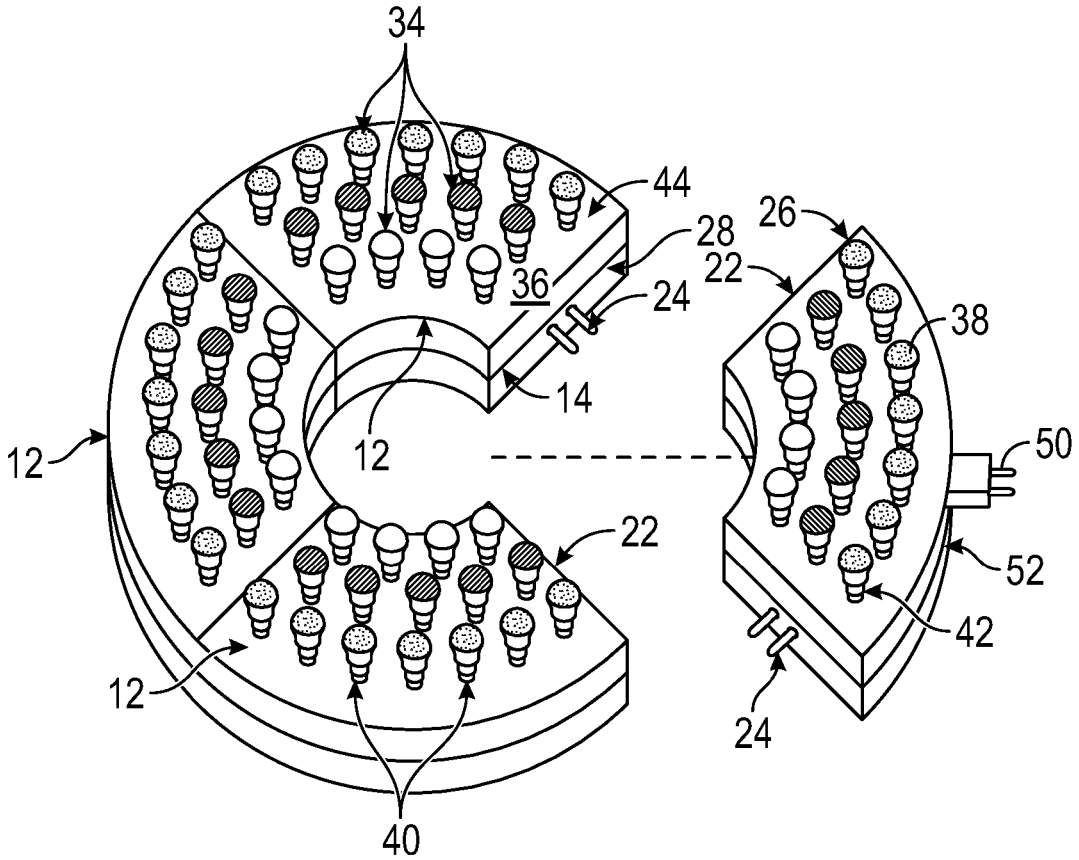
FIG. 4 is an isometric perspective view of an embodiment of the disclosure.

The present invention anticipates the plurality of lighting modules 12 being disc shaped upon interconnecting of the lighting modules 12, as shown in FIGS. 3 and 4. The plurality of lighting modules 12 thus is configured to be positioned around an upright substrate, such as trees, flagpoles, and the like. With the lighting modules 12 being disc shaped, a third connector 50 is attached to an arcuate edge 52 of the housing 14 and is configured to engage a power cord 46, which extends from a power module 48. The bulbs 34 thus are configured to selectively illuminate the upright substrate.

The present invention also anticipates the housing 14 being alternatively shaped, such as, but not limited to, triangular, trapezoidal, hexagonal, and the like, as well as irregularly shaped. In these configurations, the housings 14 may be differentiated by indicia to assure that they are connected properly. Further anticipated by the present invention is the upper face 36 of the housing 14 being textured and colored to mimic landscaping material, such as rocks, mulch, and the like.

The illuminated landscaping assembly 10 also may comprise a controller 54, which is operationally engaged to the plurality of lighting modules 12 and configured to control at least one lighting characteristic of the bulbs 34. For example, the controller 54 can be used to set a time schedule of operation for the lighting modules 12, to power the bulbs 34 in patterns, to power the bulbs 34 intermittently so that they flicker, and the like. The controller 54 also may comprise a photosensor 56 so that the bulbs 34 are only powered on when the ambient light level is low.

In use, the illuminated landscaping assembly 10 enables a method of illuminating a landscape 58 comprising a provision step 60, which entails providing a power module 48, which has a power cord 46, and an illuminated landscaping assembly 10, according to the specification above. An installation step 62 of the method 58 entails positioning the lighting modules 12 in a desired configuration in a landscape. A connecting step 64 of the method 58 entails interconnecting the lighting modules 12. A power step 66 of the method 58 entails engaging a respective one of the first connectors 22 and the second connectors 24 to the power module 48 using the power cord 46 so that the bulbs 34 are positioned to selectively illuminate the landscape.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An illuminated landscaping assembly comprising:

a plurality of lighting modules, each lighting module comprising:

a housing, a first connector attached to a first edge of the housing, a second connector attached to a second edge of the housing, the second connector being complementary to the first connector, such that the lighting modules are physically and electrically interconnectable via selective connection of the first connectors and the second connectors, wherein the plurality of lighting modules is configured for positioning in a landscape, a plurality of bulbs attached to an upper face of the housing and operationally engaged to the first connector and the second connector, and a shell attached to the housing and encapsulating the plurality of bulbs, the shell being substantially transparent; and a respective one of the first connectors and the second connectors being configured for engaging a power cord extending from a power module, wherein the bulbs are configured for selectively illuminating the landscape.

2. The illuminated landscaping assembly of claim 1, wherein:

the second connector comprises a two pronged plug; and the first connector comprises a socket connector.

3. The illuminated landscaping assembly of claim 1, wherein each bulb comprises a light emitting diode.

4. The illuminated landscaping assembly of claim 1, wherein each bulb emits a respective color, such that the plurality of bulbs comprises bulbs emitting a plurality of colors.

5. The illuminated landscaping assembly of claim 1, further including a plurality of feet attached to a lower face of the housing, wherein the feet are configured for elevating the housing above a surface upon which the housing is positioned.

6. The illuminated landscaping assembly of claim 1, further including a plurality of sockets attached to the upper face of the housing, the sockets being complementary to bases of the bulbs, such that the bulbs are removably attachable to the housing.

7. The illuminated landscaping assembly of claim 1, wherein the housing is cuboid, such that lighting modules are selectively interconnectable in a linear configuration and a configuration having one or more right angles.

8. The illuminated landscaping assembly of claim 1, further including:

the plurality of lighting modules being disc shaped upon interconnecting of the lighting modules, wherein the plurality of lighting modules is configured for positioning around an upright substrate; and a third connector attached to an arcuate edge of the housing, the third connector being configured for engaging a power cord extending from a power module, wherein the bulbs are configured for selectively illuminating the upright substrate.

9. The illuminated landscaping assembly of claim 1, further including a controller operationally engaged to the plurality of lighting modules and being configured for controlling at least one lighting characteristic of the bulbs.

10. An illuminated landscaping assembly comprising:

a lighting module comprising:

a housing, a first connector attached to a first edge of the housing, a second connector attached to a second edge of the housing, the second connector being complementary to the first connector, the second connector comprising a two pronged plug and the first connector comprising a socket connector, a plurality of bulbs attached to an upper face of the housing and operationally engaged to the first connector and the second connector, each bulb comprising a light emitting diode, each bulb emitting a respective color, such that the plurality of bulbs comprises bulbs emitting a plurality of colors, a plurality of feet attached to a lower face of the housing, wherein the feet are configured for elevating the housing above a surface upon which the housing is positioned, a plurality of sockets attached to the upper face of the housing, the sockets being complementary to bases of the bulbs, such that the bulbs are removably attachable to the housing, and a shell attached to the housing and encapsulating the plurality of bulbs, the shell being substantially transparent;

the lighting module being one of a plurality of lighting modules, such that the lighting modules are physically and electrically interconnectable via selective connection of the first connectors and the second connectors, the housing being cuboid, such that the lighting modules are selectively interconnectable in a linear configuration and a configuration having one or more right angles, wherein the plurality of lighting modules is configured for positioning in a landscape;

a respective one of the first connectors and the second connectors being configured for engaging a power cord extending from a power module, wherein the bulbs are configured for selectively illuminating the landscape; and a controller operationally engaged to the plurality of lighting modules and being configured for controlling at least one lighting characteristic of the bulbs.

11. The illuminated landscaping assembly of claim 10, further including:

the plurality of lighting modules being disc shaped upon interconnecting of the lighting modules, wherein the plurality of lighting modules is configured for positioning around an upright substrate; and a third connector attached to an arcuate edge of the housing, the third connector being configured for engaging a power cord extending from a power module, wherein the bulbs are configured for selectively illuminating the upright substrate.

12. A method of illuminating a landscape comprising the steps of:

providing a power module having a power cord and an illuminated landscaping assembly, the illuminated landscaping assembly comprising a plurality of lighting modules, each lighting module comprising:

a housing, a first connector attached to a first edge of the housing, a second connector attached to a second edge of the housing, the second connector being complementary to the first connector, such that the lighting modules are physically and electrically interconnectable via selective connection of the first connectors and the second connectors, a plurality of bulbs attached to an upper face of the housing and operationally engaged to the first connector and the second connector, and a shell attached to the housing and encapsulating the plurality of bulbs, the shell being substantially transparent, and a respective one of the first connectors and the second connectors being configured for engaging a power cord extending from a power module, positioning the lighting modules in a desired configuration in a landscape;

interconnecting the lighting modules; and engaging a respective one of the first connectors and the second connectors to the power module using the power cord, such that the bulbs are positioned for selectively illuminating the landscape.

* * * * *